US006009958A

United States Patent [19]

Nakata et al.

[11] Patent Number: 6,009,958

[45] Date of Patent: Jan. 4, 2000

[54] SOIL SAMPLING APPARATUS AND A GEOLOGICAL OBSERVATION METHOD USING THE SAME

[75] Inventors: Takashi Nakata, Hiroshima; Kunihiko Shimazaki, Matsudo, both of Japan

[73] Assignee: President of Hiroshima University, Higashihiroshima, Japan

[21] Appl. No.: 08/919,780

[22] Filed: Aug. 29, 1997

[30] Foreign Application Priority Data

Feb. 21, 1997 [JP] Japan ..... 9-037488

[51] Int. Cl.[7] ..... E21B 49/02

[52] U.S. Cl. ..... 175/20; 175/21; 175/58; 73/864.41; 73/864.44

[58] Field of Search ..... 175/20, 21, 58; 73/864.41, 864.44

[56] References Cited

U.S. PATENT DOCUMENTS

| | | | |
|---|---|---|---|
| 828,527 | 8/1906 | Ankeny | 73/864.44 |
| 1,919,461 | 7/1933 | Burke et al. | 175/58 |
| 3,373,826 | 3/1968 | Ingram | 175/58 |
| 4,244,614 | 1/1981 | Madsen | 294/50 |
| 5,474,141 | 12/1995 | Hart | 175/58 |

FOREIGN PATENT DOCUMENTS

| | | | |
|---|---|---|---|
| 617702 | 7/1978 | U.S.S.R. | 175/20 |

*Primary Examiner*—William Neuder
*Assistant Examiner*—Chi H. Kang
*Attorney, Agent, or Firm*—Oblon, Spivak, McClelland, Maier & Neustadt, P.C.

[57] ABSTRACT

A soil sampling apparatus includes a sampling box for penetrating the ground first, and a shutter plate for subsequently penetrating the ground while engaging with the sampling box, thereby sampling soil layers located in a space surrounded by the sampling box and the shutter plate.

10 Claims, 5 Drawing Sheets

SOIL SAMPLING APPARATUS AND A GEOLOGICAL OBSERVATION METHOD USING THE SAME

BACKGROUND OF THE INVENTION

1. Field of the Invention

The present invention relates to a soil sampling apparatus used for geological studies, civil engineering and the like, and a geological observation method using this apparatus.

2. Description of the Related Art

Hitherto, geological sections are observed upon boring the ground in various scientific studies. However, unconsolidated samples obtained by boring are usually disturbed, and the original sedimentary structure of the geological sections can not be observed by the samples.

Trench surveying (Trenching) is also popular as a conventional geological observation method. Trenching is a survey in which a groove, called a trench, is formed in the ground, and geological sections appearing on the inner wall surface of the trench are observed to survey particularly active faults.

Trenching is conducted by heavy civil engineering machinery and produces a large amount of excavated soil in order to make outcrops on trench walls. A stockyard for such large amount of excavated soil must be secured and the soil must be buried in the trench again, requiring a high survey cost.

To survey geographical sections continuously, a wall section under observation must be cut to expose the next observation wall surface. For this reason, the cut observation wall surface cannot be observed or inspected again.

On the other hand, to prevent trench walls from collapsing during observation, trench walls must be maintained at a predetermined gradient. Even in this case, there is always a danger of collapse. In addition, the trench itself can not be excavated easily in soft ground where the ground water level is very high.

On soft ground, to obtain a 3 m wide and 3 m deep outcrop on a trench wall, we need to use a 10 m by 10 m wide land. Therefore, we may loose important geological evidence during an excavation process.

As described above, time-, labor- and cost-intensive works are required in any conventional geological observation method for obtaining subsurface soil layers. In addition, great difficulty is expected in securing sites wide enough to conduct a survey in highly populated areas.

SUMMARY OF THE INVENTION

It is an object of the present invention to provide a simple soil sampling apparatus capable of properly obtaining undisturbed soil samples from a ground without requiring a wide area to conduct a sampling, and a geological observation method using this soil sampling apparatus.

According to the first aspect of the present invention, there is provided a soil sampling apparatus comprising a first soil sampling member for penetrating the ground first, and a second soil sampling member for subsequently penetrating the ground while engaging with the first soil sampling member, thereby sampling soil layers located in a space surrounded by the first and second soil sampling members.

With the above structure, vertical flat sections of soil layers can be vertically sampled, and a three-dimensional survey for an active fault or the like can be performed.

It is desirable that the space surrounded by the first and second soil sampling members gradually narrows toward a penetration direction. With this structure, the sampled soil layers can be effectively prevented from dropping downward.

According to the second aspect of the present invention, there is provided a geological observation method comprising the steps of: vertically penetrating into ground a soil sampling apparatus capable of sampling soil layers in the form of a flat-sheet; removing the soil sampling apparatus from the ground; and observing an undisturbed flat section of the sampled soil layers.

According to this method, soil sampling can be simply performed without requiring a large land, and the extended soil layers can be observed on the ground. Therefore, the soil sections can be safely observed.

With the above arrangement, the soil layers are continuously sampled a number of times, and the soil samples can be observed on the ground, thereby easily clarifying the three-dimensional structure of the soil.

Additional objects and advantages of the invention will be set forth in the description which follows, and in part will be clear from the description, or may be learned by practice of the invention. The objects and advantages of the invention may be realized and obtained by the instrumentalities and combinations particularly pointed out below.

BRIEF DESCRIPTION OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Preferred embodiments of the present invention will be described below with reference to the accompanying drawing figures.

Figure 1:
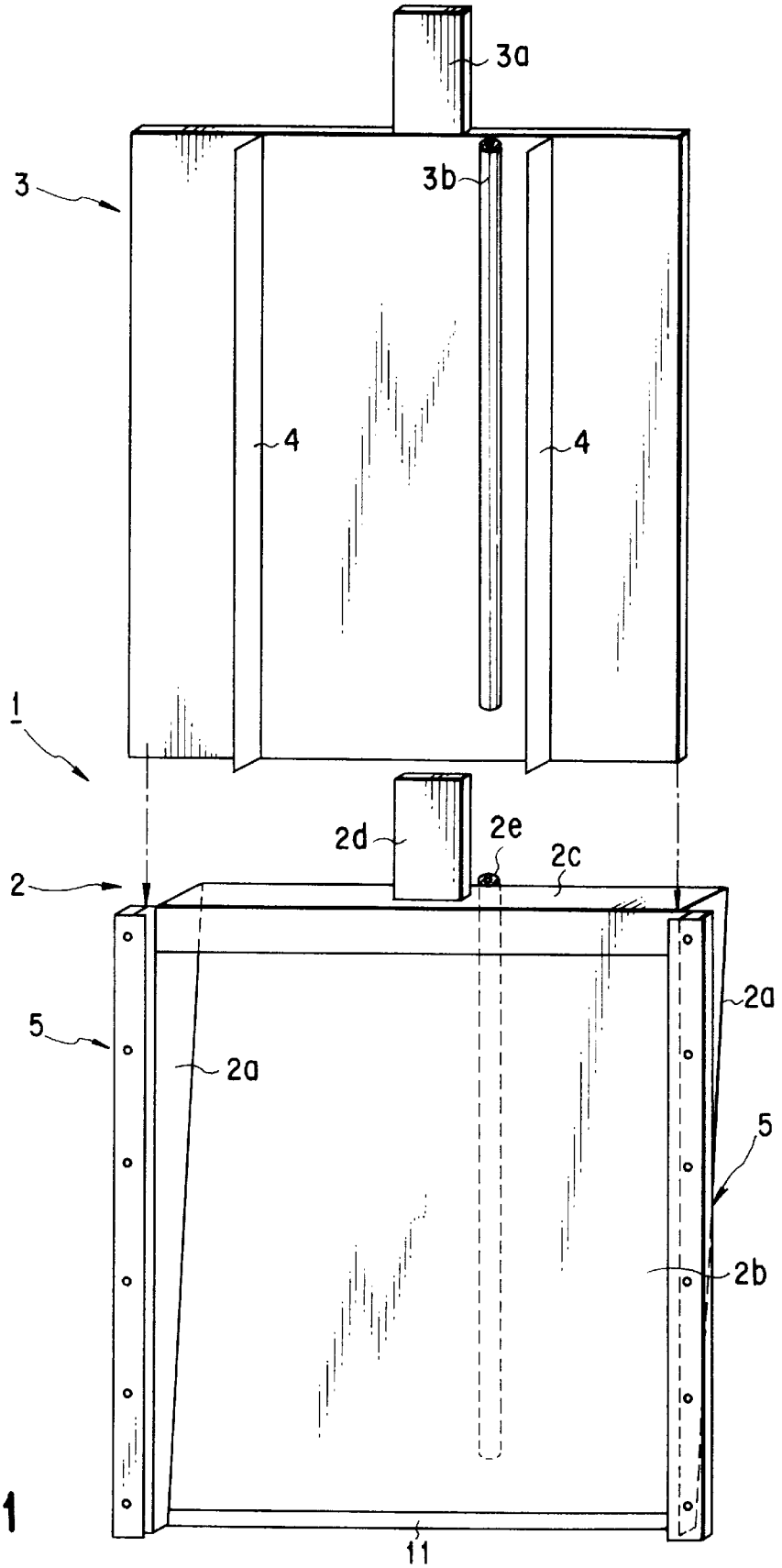
FIG. 1 is an exploded perspective view of a soil sampling apparatus according to an embodiment of the present invention.

FIG. 1 is an exploded view showing an embodiment of a soil sampling apparatus 1 used in a geological observation method of the present invention.

This soil sampling apparatus 1 is made to penetrate the ground to hold soil layers therein. When the apparatus 1 is removed from the ground, the soil layers can be sampled. The apparatus 1 comprises a sampling box 2 (first soil sampling member) having a U-shaped cross-section and a flat shutter plate 3 (second soil sampling member) slidably combined with the sampling box 2 to close the open side of the sampling box 2.

As will be described later, in this apparatus, the sampling box 2 is made to penetrate the ground first, and then the shutter plate 3 is made to penetrate the ground so as to combine with the sampling box 2 to divide the soil layers held in the sampling box 2 from the surrounding soil layers. A pair of reinforcing plates 4 is attached to the back surface of the shutter plate 3. The pair of reinforcing plates 4 prevent deformation of the shutter plate 3 during penetration.

On the other hand, the sampling box 2 comprises a pair of side plates 2*a*, a rear plate 2*b*, and an upper closing plate 2*c*, part of which extends on the open side. The sampling box 2 has a shape in which most of the front surface and the lower surface are open. The rear plate 2*b* is inclined at a predetermined angle so that the cross-section of the sampling box 2 is gradually reduced downward. Penetration direction regulation portions 5 are formed on the corresponding side portions of the side plates 2*a* to regulate the insertion direction of the shutter plate 3 along the side portions of the side plates 2*a*.

Figure 2C:
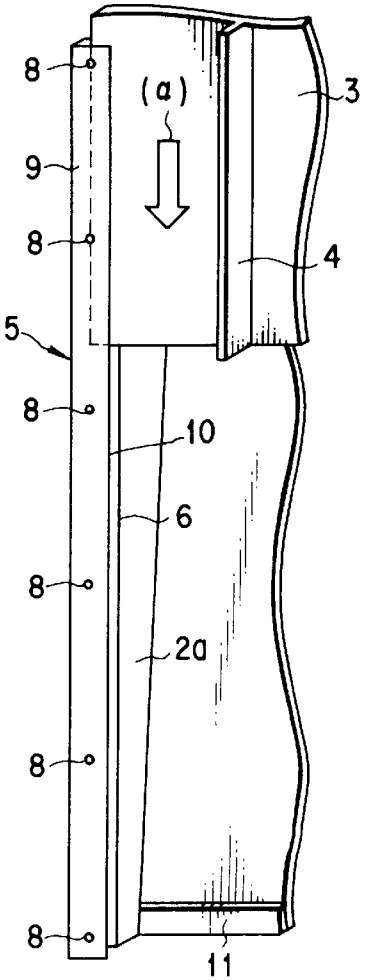
FIGS. 2A to 2C are enlarged perspective views showing part of the soil sampling apparatus.
Figure 2B:
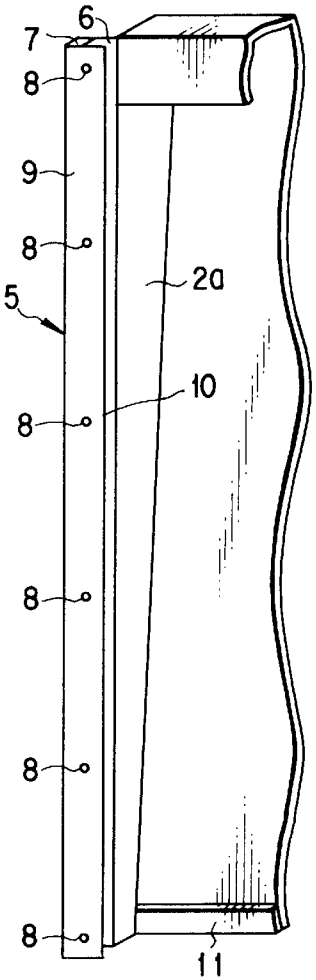
Figure 2A:
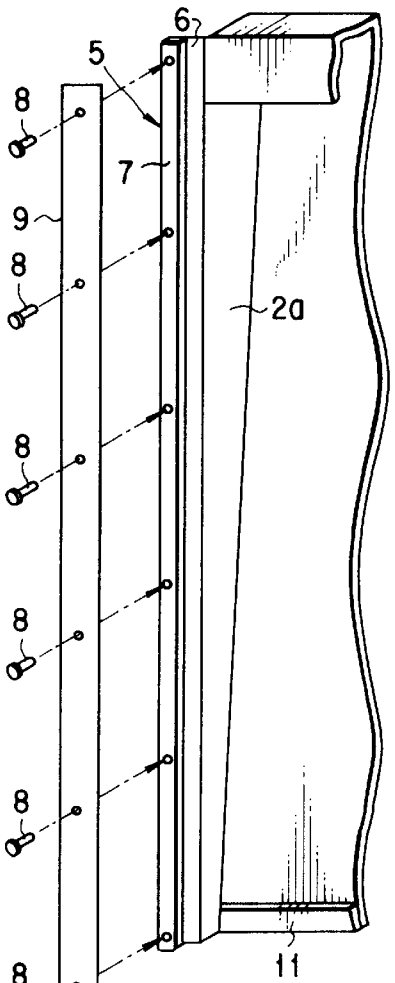

Each insertion direction regulation portion 5 has a structure as shown in FIGS. 2A to 2C. More specifically, as shown in FIG. 2A, the portion 5 comprises a band-like flange portion 6 obtained by bending an open side portion of the corresponding side plate 2*a* outward, a metal spacer 7 formed in a band-like shape having a width smaller than that of the flange portion 6 and welded to an outer edge portion of the flange portion 6, and a guide plate 9 formed in a band-like shape roughly conforming to the flange portion 6 and fixed to the flange portion 6 with bolts 8 and nuts (not shown) through holes in the spacer 7, as shown in FIGS. 2A and 2B. With this structure, a groove 10 for slidably receiving the corresponding edge of the shutter plate 3 in the direction of an arrow (α) in FIG. 2C is formed between the flange portion 6 and the corresponding guide plate 9. After the shutter plate 3 is mounted in the sampling box, the bolts 8 are removed to remove the guide plates 9, so that the shutter plate 3 can be removed in the lateral direction (i.e., a direction pointing out of the page and perpendicular to the direction of the arrow (α)) without vertically sliding to remove the shutter plate 3.

A band-like member 11 (soil drop preventive member) is fixed, as seen in FIG. 1 to the lower end portion of the rear plate 2*b* of the sampling box 2. This band-like member 11 has a function of reinforcing the lower end portion of the rear plate 2*b* and preventing its deformation, and at the same time a function of preventing the sampled soil layers from slipping-off.

The steps in sampling and observing soil layers using this soil sampling apparatus will be described with reference to FIGS. 3A to 3F.

(1) Step of Leading Penetration of Sampling Box 2

Figure 3A:
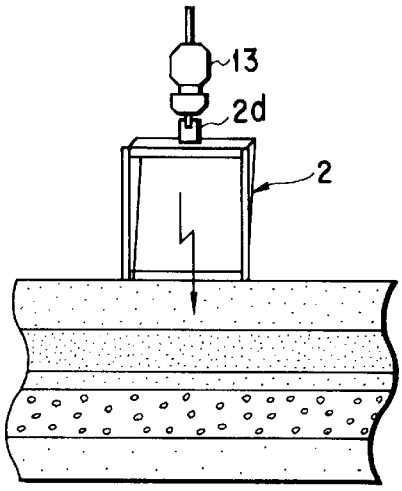
FIGS. 3A to 3F are sectional views showing the sampling steps of the soil sampling apparatus.
Figure 3B:
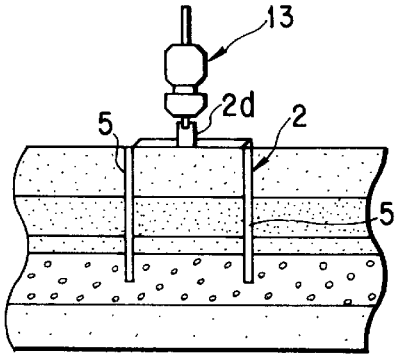

As shown in FIGS. 3A and 3B, the sampling box 2 is inserted into the ground to a predetermined depth.

A tongue portion 2*d* at the upper end portion of the sampling box 2 is held with a vibrohammer (vibrating unit) 13, and the sampling box 2 is made to penetrate while vibrating it. In this case, it is important that the sampling box 2 penetrate ground while its side plates 2*a* and 2*b* are kept vertical or perpendicular to the ground surface.

Preferably, the vibrohammer 13 is suspended from a crane or power shovel (not shown), and the penetration speed of the sampling box 2 is adjusted in accordance with the weight and vibrations of the vibrohammer 13, so that a large load does not act on the sampling apparatus 1. Therefore, any deformation of the sampling apparatus during penetration can be prevented.

(2) Step of Penetration of Shutter Plate 3

Figure 3C:
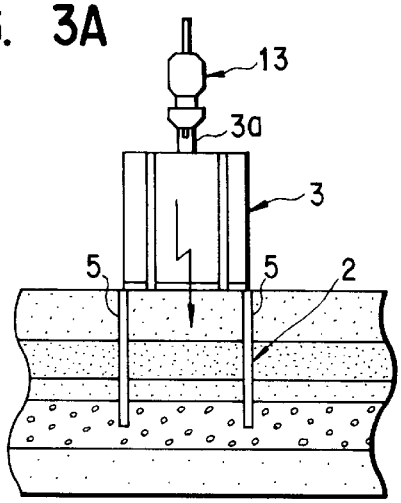
Figure 3D:
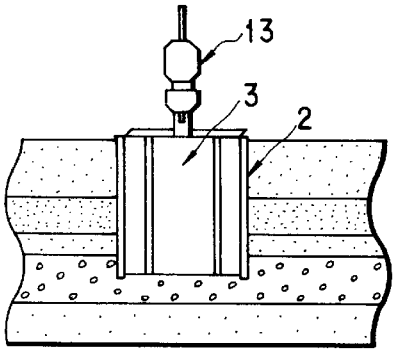

As shown in FIGS. 3C and 3D, the shutter plate 3 is made to penetrate the ground while being slidably combined with the penetration direction regulation portions 5 of the sampling box 2. As in the sampling box 2, a tongue portion 3*a* formed at the upper portion of the shutter plate 3 is held and vibrated with the vibrohammer 13, and the shutter plate 3 is made to penetrate while the penetration speed is adjusted.

As described above, the sampling box 2 is made to penetrate the ground first to cut soil layers in a U shape, and then the shutter plate 3 is made to penetrate to perfectly divide the soil layers from the surrounding soil layers in the space (soil storage portion) partitioned by the sampling box 2 and the shutter plate 3, thereby obtaining the divided soil layers as a sample.

(3) Step of Removal of Sampling Apparatus 1

Figure 3E:
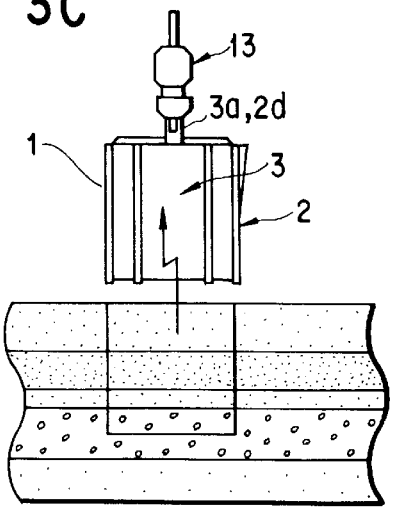

As shown in FIG. 3E, the sampling apparatus 1 is removed upward together with the soil layers accommodated in the sampling box 2. At this time, it is important to slowly pull up the sampling apparatus 1 so as not to allow the sampling box 2, the shutter plate 3, and the soil layers held in the space to slide relative to each other. Since the rear plate 2*b* of the sampling box 2 is inclined downward, as seen in FIG. 1, i.e., since the soil storage portion is tapered, the sampled soil layers can be prevented from slipping downward. Drop of the soil layers can also be prevented by the band-like member 11 formed at the lower end of the rear plate 2*b*.

On the other hand, where a vacuum condition is caused around the sampling apparatus 1 when the sampling apparatus is pulled off from the ground, compressed air can be sent through the pipes 2*e* and 3*b* welded on the back surface of the sampling box 2 and the shutter plate 3 (as shown in FIG. 1) to ease the vacuum condition, so that the sampling apparatus 1 can be easily pulled out from the ground.

(4) Step of Removal of Shutter Plate 3 and Observation

Figure 3F:
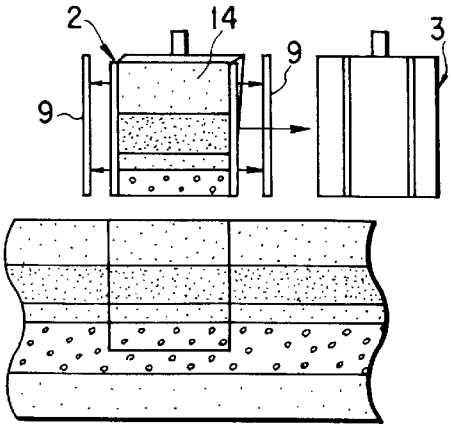

Finally, the shutter plate 3 is removed from the sampling box 2 to expose the vertical profile of sampled soil layers 14, as shown in FIG. 3F, and necessary examinations are made. Preferably, in this step, the soil sampling apparatus 1 pulled up from the ground is laid down with the shutter plate 3 facing up, the bolts 8 and the nuts are untightened to remove the guide plates 9 from the sampling box 2, and then the shutter plate 3 is removed. At this time, care must be taken not to cause the shutter plate 3 to scrape off the surface of the sampled soil layers 14.

Figure 4A:
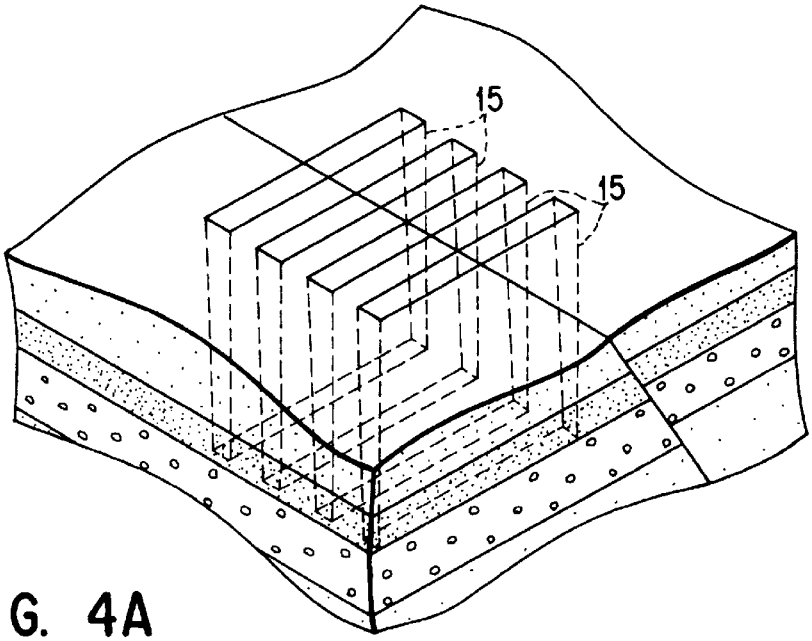
FIGS. 4A and 4B are perspective views for explaining the sampling method.
Figure 4B:
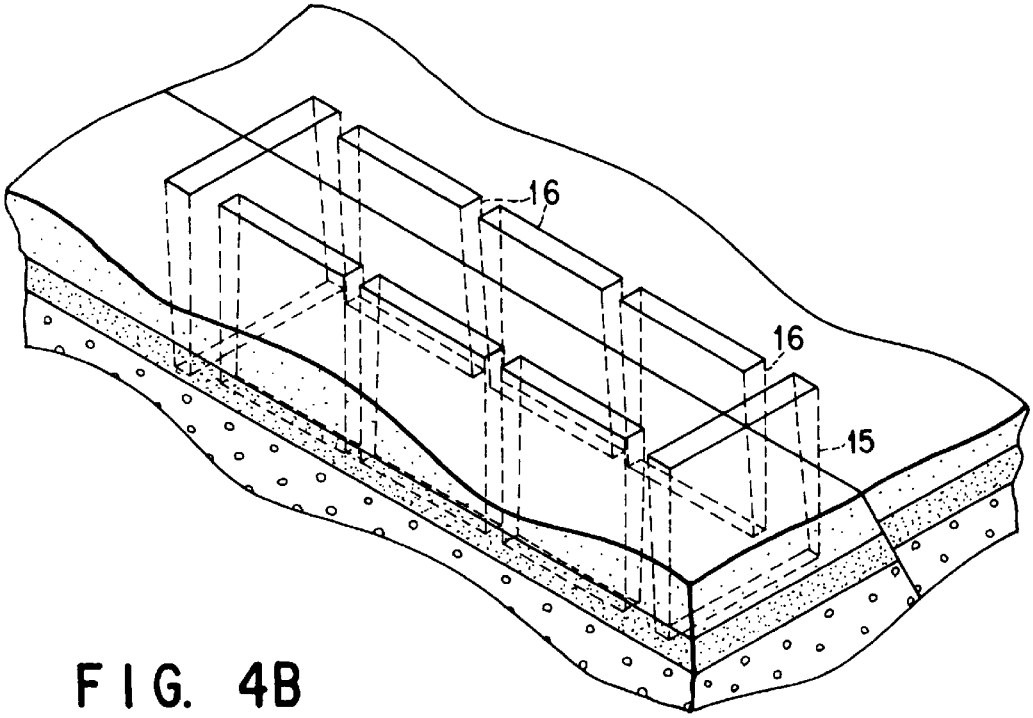

An example of the application field of this soil sampling apparatus 1 is an active fault survey for examining an earthquake cycle. More specifically, the soil sampling apparatus 1 is used in a manner illustrated in FIG. 4A, in which a plurality of soil layers 15 are sampled in a direction perpendicular to an active fault, and the vertical profiles of the sampled soil layers are observed to explain the three-dimensional structure of this active fault. Alternatively, soil layers very close to an active fault are sampled parallel to the active fault, and the vertical profiles of the sampled soil layers 16 are observed, as indicated in FIG. 4B. This sampling allows surveyors to find the lateral displacement of the active fault.

With the above arrangements, the following effects can be obtained.

First, the soil sampling apparatus 1 has a simple structure constituted by the sampling box 2 and the shutter plate 3. Only a minimum number of necessary soil layers determined by the size of the sample storage portion partitioned by the sampling box 2 and the shutter plate 3 can be sampled.

Second, since the soil sampling apparatus 1 has a structure in which the sectional area is gradually reduced downward, i.e., the inner surfaces of the sample storage portion are formed into a tapered shape, the sampled soil layers can be effectively prevented from slipping-off. With this structure, as the soil sampling apparatus 1 is pulled upward, gaps between the soil sampling apparatus and the surrounding soil layers are formed, and the ambient space of the apparatus 1 is not set in a vacuum during removal of the apparatus 1. For this reason, the soil sampling apparatus 1 can be smoothly removed upward without any resistance, thereby properly sampling soil layers.

Third, since the guide plates 9 are detachably mounted on the sampling box 2, the penetration direction of the shutter plate 3 can be regulated in a direction to cut soil layers during penetration of the apparatus, and the shutter plate 3 can be removed without scraping off the surface of the sampled soil layers. Therefore, the surface of the sampled soil layers can be effectively prevented from being disturbed. A geological survey can be performed in a best state.

Fourth, unlike the conventional trench survey method, since the sampled soil layers can be kept in a good state, the soil layers can be repeatedly observed.

Fifth, as compared with a case in which the wall surface of a trench is visually observed like in the trench survey method, cost and labor can be reduced. In addition, ground collapses during observation do not occur.

The present invention is not limited to the above embodiment. Various changes and modifications may be made without departing from the spirit and scope of the invention.

Figure 5:
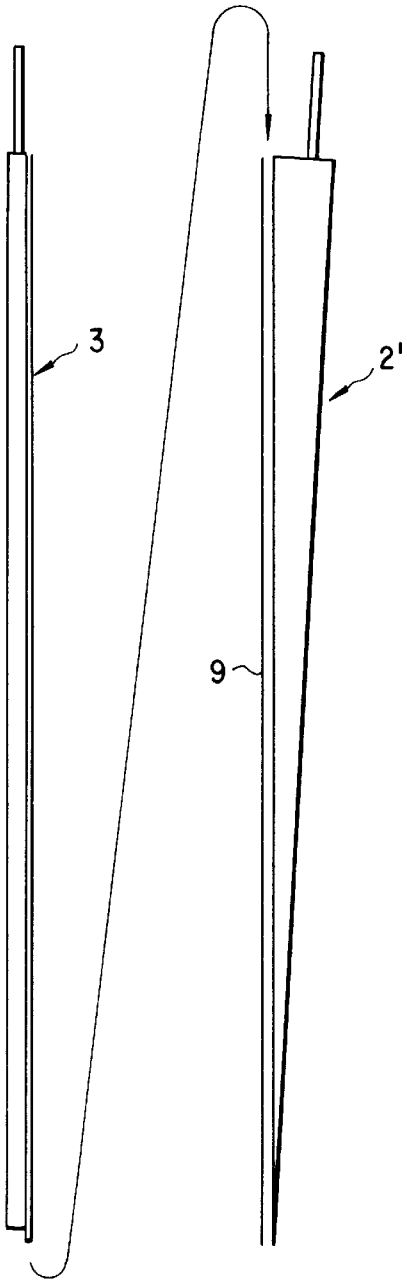
FIG. 5 is a side view showing another embodiment.

For example, in the soil sampling apparatus 1 described as one embodiment, the lower end is open while the sampling box 2 and the shutter plate 3 are combined. However, according to an apparatus shown in FIG. 5, when the shutter plate 3 is combined with a sampling box 2', the lower end may be closed. With this structure, even a nonconcrete soil such as a highly fluid sand layer saturated with water can be properly sampled.

The guide plates 9 are not limited to the one described in the above embodiment. Various changes may be made, as shown in FIGS. 6A to 6C.

Figure 6A:
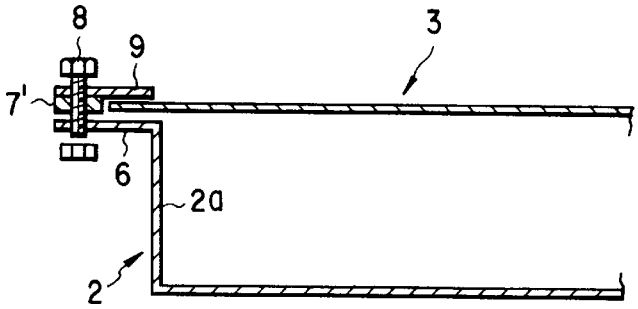
FIGS. 6A to 6C are cross-sectional views showing other embodiments.
Figure 6B:
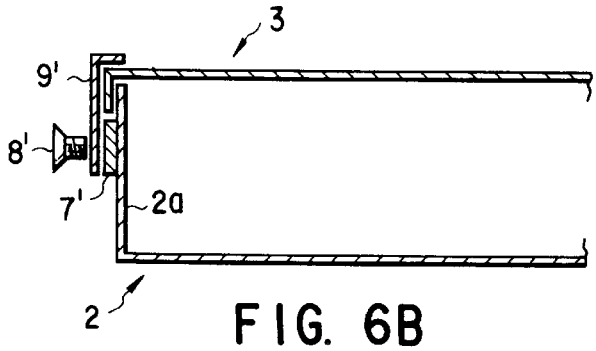
Figure 6C:
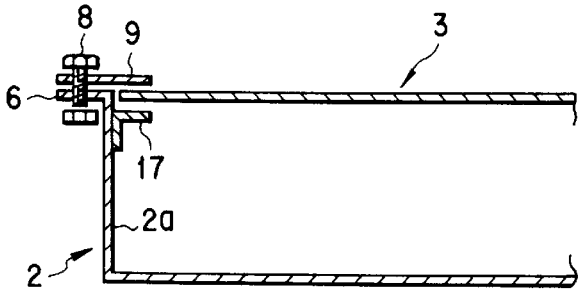

In a structure shown in FIG. 6A, a spacer 7' like the one described above is fixed or welded to the guide plate 9. In a structure shown in FIG. 6B, a guide plate 9' is attached to the outer surface of the side plate 2*a* of the sampling box 2. In a structure shown in FIG. 6C, a flange portion 17 is formed inside the sampling box 2 to eliminate the need for a spacer. The spacer 7 is not limited to a metal one, but may be made of an elastic material such as rubber and fixed with adhesion or the like.

The sampling box 2 has a U-shaped cross-section, but the shape of the sampling box 2 is not limited to this cross-section. Any shape may be employed when soil can be cut by side plates and can be sampled. In the first embodiment described above in FIG. 6A, after the sampling box 2 is made to penetrate first, the shutter plate 3 is made to penetrate. The penetration order is not limited to this sequence. After the shutter plate 3 is made to penetrate first, the sampling box 2 may be made to penetrate. In this case, the penetration direction regulation portions 5 are preferably formed on the shutter plate 3.

In the above embodiments, a vibrohammer is used as the vibrating unit, but the vibrating unit is not limited to this device. Various nonvibratory penetration units may be used to perform penetration without using such a vibrating unit.

Other fields in which the soil sampling apparatus may be used, are an archaeological survey, a soil profile survey, a public work survey, excavation of a narrow underground trench, and construction works such as underground walls.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A soil sampling apparatus comprising:

a first soil sampling member for penetrating the ground first; and a second soil sampling member for subsequently penetrating the ground while engaging with said first soil sampling member, thereby sampling soil layers located in a space surrounded by said first and second soil sampling members;

wherein said first soil sampling member has an insertion direction regulation member for regulating a penetrating direction of said second soil sampling member; and wherein said insertion direction regulation member is detachably attached to said first soil sampling member to allow removal of said first/second soil sampling member without scraping of a surface of sampled soil layers.

2. An apparatus according to claim 1, wherein said space gradually narrows toward a penetration direction.

3. An apparatus according to claim 1, further comprising a soil slip-off preventive member arranged at a lower end portion of at least one of said sampling members for preventing said sampled soil layers from slipping off the apparatus.

4. An apparatus according to claim 1, further comprising means for supplying air into a space outside of the first and second soil sampling member to enable said first and second soil sampling member to be easily pulled out of the ground.

5. An apparatus according to claim 1, in combination with a unit for vibrating said first and second soil sampling members during penetration of said first and second soil sampling members.

6. A soil sampling apparatus comprising:

a first soil sampling member configured to penetrate the ground first;

a second soil sampling member configured to penetrate the ground subsequently while engaged with the first soil sampling member, thereby sampling soil layers located in a space surrounded by the first and second soil sampling members; and an insertion direction regulation member being positioned to regulate a penetrating direction of the second soil sampling member and also being detachably attached to the first soil sampling member to allow removal of the first and second soil sampling members without scraping of a surface of sampled soil layers.

7. A soil sampling apparatus according to claim 6, wherein the surrounded space gradually narrows towards the penetrating direction.

8. A soil sampling apparatus according to claim 6, further comprising:

a soil slip-off preventive member arranged at a lower end portion of at least one of the sampling members so that the sampled soil layers are prevented from slipping off the apparatus.

9. A soil sampling apparatus according to claim 6, further comprising:

an air supply device fitted into a space outside of the first and second soil sampling members so as to enable the first and second soil sampling members to be easily pulled out of the ground.

10. A soil sampling apparatus according to claim 6, in combination with a vibrator arranged to vibrate the first and second soil sampling members during penetration of the first and second soil sampling members into the ground.

* * * * *